United States Patent [19]

Tung et al.

[11] 4,248,932

[45] Feb. 3, 1981

[54] EXTENDED-LIFE PAVEMENT-MARKING SHEET MATERIAL

[75] Inventors: Chi F. Tung, Mahtomedi; George W. Frost, Jr., Woodbury, both of Minn.

[73] Assignee: Minnesota Mining and Manufacturing Company, Saint Paul, Minn.

[21] Appl. No.: 48,644

[22] Filed: Jun. 14, 1979

[51] Int. Cl.[3] ..... B32B 5/16; E01F 9/00

[52] U.S. Cl. ..... 428/325; 404/20; 428/323; 428/332; 428/339; 428/418; 428/429; 428/447; 428/522; 428/405

[58] Field of Search ..... 428/325, 405, 323, 418, 428/429, 447, 522, 332, 339; 404/19, 20, 12, 14, 94

[56] References Cited

U.S. PATENT DOCUMENTS

| | | | |
|---|---|---|---|
| 3,227,604 | 1/1966 | Morgan | 404/20 |
| 3,436,359 | 4/1969 | Hubin | 260/2 |
| 3,527,146 | 9/1970 | Garling | 404/19 |
| 3,915,771 | 10/1975 | Gatzke | 428/325 |
| 3,935,365 | 1/1976 | Eigenmann | 428/325 |
| 4,020,211 | 4/1977 | Eigenmann | 428/325 |
| 4,117,192 | 9/1978 | Jorgensen | 428/325 |
| 4,146,635 | 3/1979 | Eigenmann | 428/325 |

*Primary Examiner*—Ellis P. Robinson

*Attorney, Agent, or Firm*—Cruzan Alexander; Donald M. Sell; Roger R. Tamte

[57] ABSTRACT

A new pavement-marking sheet material comprises a conformable base sheet, a flexible top layer adhered to the base sheet, and glass microspheres or other particulate material partially embedded and strongly supported and adhered in the top layer.

21 Claims, 2 Drawing Figures

EXTENDED-LIFE PAVEMENT-MARKING SHEET MATERIAL

BACKGROUND OF THE INVENTION

A continuing goal in the pavement-marking industry is to find economical products from which to form traffic-control stripes having a longer useful life than the commonly used painted stripes. The inability to satisfy this goal is indicated by the variety of products presently used to form stripes on a roadway:

One variety comprises paints based on epoxy resin, which provide longer life, but which nevertheless have achieved only a small usage, probably because their slow cure necessitates elaborate and expensive application procedures. Also, the applied lines tend to spall and crack, show little impact resistance, and discolor with age.

Thicker coatings, such as thermoplastic polymers extruded or sprayed while in a molten condition, have produced some increase in life because of the greater amount of material to be worn away. However, the increased amount of material also increases the cost of the markings, and expensive equipment and uncomfortably not procedures are required to apply them. Also, the high profile of these markings can be disturbing to passing traffic, and the lines are especially susceptible to removal by snowplow blades. The markings will also spall, especially from concrete, apparently because of the mismatch between the rigid thick markings and the concrete as to thermal expansion characteristics.

Preformed thick tapes of reduced elasticity have provided long useful life, but their cost has generally limited them to use in urban-type markings, such as short-distance lane striping, or stop bars or pedestrian lane markings at intersections, where heavy traffic, stop-start vehicle movements, and turning of vehicles inflicts severe stress.

Thinner preformed tapes have also been used, such as tapes comprising dead-soft aluminum foil carrying pigmented vinyl-based coatings in which glass microspheres or other particulate material is partially embedded. Such tapes are generally less expensive than the thicker preformed tapes described above, and their exceptional conformability assists in developing good adhesion to a roadway. However, these tapes are shorter-lived than the thicker preformed tapes, and their cost/life balance has generally limited them to specialized uses, such as temporary construction markings.

In sum, no presently used marking approach stands out as a superior-performance techhique, broadly suitable for large-scale marking such as down-the-road lane-striping on highways.

SUMMARY OF THE INVENTION

The present invention provides a new pavement-marking sheet material having a dramatically increased useful life over comparable previous pavement-marking sheet materials.

Briefly, the new pavement-marking sheet material of the invention comprises (1) a base sheet, such as dead-soft aluminum, that is conformable to a roadway surface;

(2) a top layer adhered to one surface of the base sheet and reacted to a substantially infusible, insoluble, and flexible state in which the top layer conforms and remains adhered to the base sheet without rupture even when the sheet material is wrapped around a one-millimeter-diameter mandrel; and (3) a monolayer of particles, such as glass microspheres, or sand, which are partially embedded in the top layer and partially exposed above the top layer, and which are encircled by the top layer so as to be strongly supported and adhered in the top layer.

The support provided the partially embedded particles in sheet material of the invention contrasts with the support provided in the prior-art aluminum-foil-based sheet materials. During manufacture of the prior-art materials, the microspheres or other particles are dropped into a solution of binder material coated on the base sheet. The coated solution fillets up the sides of the particles, but in the locations between the microspheres, the coating is greatly reduced in thickness by the loss of solvent. Microscopic examination of the completed sheet material shows that this filleting, solvent-evaporation process leaves the particles supported on pillars or pedestals of dried binder material, and the only binder material surrounding the microspheres is the thin fillet of binder material left as the solvent evaporated.

These dried pillars of binder material provide little resistance to removal of the particles from the top layer by the abrasive and other forces applied to the marking during use. Both the pillars and the thin fillet of binder material around the particles can be flexed by these forces, and eventually the forces holding the particles in the top layer are overcome and the particles are knocked loose from the top layer.

In sheet material of the invention, the top layer generally also fillets around the embedded particles, but the fillet is a "flat" fillet, i.e., a fillet in which the top layer recedes only gradually and slightly from its level on the embedded particles. Such a flat fillet can be achieved by formation of the top layer from a liquid that has little if any solvent in it, so that there is little if any reduction in thickness of the top layer during drying or curing of the layer. In general, the fillet is sufficiently flat so that, at points one radius removed from an average-diameter particle, the top layer has a thickness of at least one-third of the particle diameter, and the top layer has receded below its level on the average-diameter particle, if at all, by no more than one-third the particle diameter, and preferably by no more than one-fourth the particle diameter.

Use of a reacted top layer also improves the bonding or adhesion to the embedded particles, and this adhesion is enhanced in preferred sheet materials by use of an adhesion-promoting or coupling agent such as a silane coupling agent at the interface between the particles and the top layer. A presently preferred top layer is based on epoxy resin, and preferably also includes flexibilizing polymer which provides at least 5 weight-parts of elastomeric segments[1] in the top layer per 100 parts of epoxy resin segments[1] (footnotes are at the end of the specification). The flexibilized nature of the top layer resists impacts that tend to loosen the particles in their sockets, and also leaves the sheet material with desired conformability.

1. "Elastomer" and "elastomeric" are used in this specification to describe substances that can be stretched at room temperature to at least twice their original length, and after having been stretched and the stress removed, return with force to approximately their original length in a short time. "Vulcanizable elastomer-precursor," or more simply "elastomer-precursor," is used in this specification to mean polymeric materials that may be crosslinked in a vulcanizing-type reaction to provide a substance that meets the above description. As an example, for purposes of this specification, "vulcanizable elastomer-precursor" and "elastomer-precursor" include so-called liquid elastomers such as liquid acrylonitrile-butadiene polymers. "Segment" is used in this specification to mean a molecule or portion of a molecule. "Elastomeric segments" is used to describe either separate elastomeric molecules or portions of molecules that would be elastomers or vulcanizable elastomer precursors as described above if they were a separate molecule rather than a portion of a molecule. "Epoxy-resin segments" is used to describe either separate molecules having one or more reactive epoxy groups or to describe portions of molecules that have the same structure and composition as the separate epoxy resin molecules just described.

The reacted and flexibilized top layer also resists temperature extremes better than in the previous aluminum-foil-based sheet material. Impacts that cracked the top layer of the previous sheet material at freezing temperatures do not crack the top layer in the new sheet material. Also, because of its reacted nature, the top layer resists softening at higher temperatures, and resists the solvent effects of gasoline and other ambient chemicals.

Based on our testing, sheet material of the invention gives promise of unusually long useful life, which we believe arises from the retention of the glass microspheres or other particles in the top layer. The particles appear to be more wear-resistant than the organic binder material (interestingly, the preferred epoxy-based top layer described above does not appear to have significantly more abrasion resistance than the vinyl-based top layer in the prior-art aluminum-foil-based product), and the particles interfere with direct contact by vehicle tires on the top layer. Also, the continued presence of glass microspheres lengthens the period of useful retroreflectivity by the marking.

DETAILED DESCRIPTION

Figure 1:
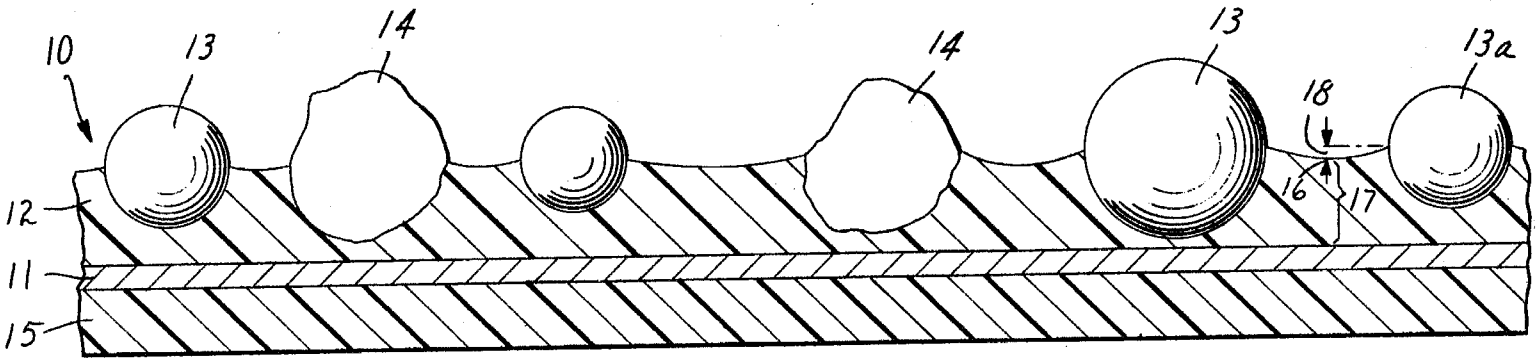
FIG. 1 PRIOR ART
FIG. 1 is a sectional view through a representative sheet material of the invention 10. The sheet material 10 comprises a conformable base sheet 11; a top layer 12 adhered to one side of the base sheet; wear-resisting particles in the form of glass microspheres 13 and skid-resisting particles 14 partially embedded in the top layer 12; and a layer 15 of adhesive carried on the other side, or back surface, of the base sheet 11. As may be seen, the top layer is filleted around the wear-resisting particles in a flat fillet such that at points 16 one radius removed from the periphery of an average-diameter particle (assumed for illustrative purposes as the microspheres 13*a*), the top layer has a thickness 17 that is at least one-third the diameter of the shpere 13*a*, and the top layer has receded below its level on the sphere 13*a* by no more than one-third diameter (i.e., the distance 18 is no more than one-third the diameter of the sphere 13*a*).
Figure 2:
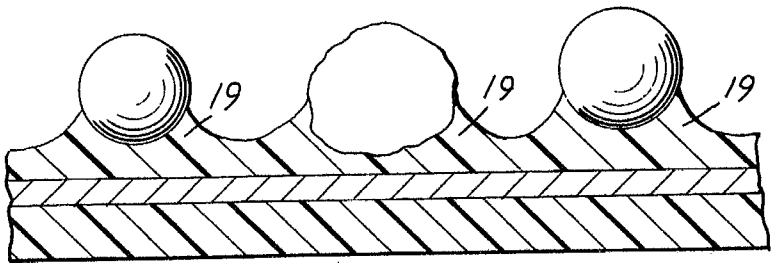
FIG. 2 is a sectional view through a prior-art sheet material, which includes the same basic structural components as the sheet material of FIG. 1, but in which the microspheres and skid-resisting particles rest on pillars 19 of binder material rather than being embedded deeply into the top layer.

The preferred base sheet for use in the invention is dead-soft aluminum foil, which is easily conformable and almost totally retains a shape to which it is conformed without any additional application of conforming pressure. Other useful conformable base sheet materials include the reduced-elasticity sheet materials described in Jorgensen, U.S. Pat. No. 4,117,192, which comprise unvulcanized elastomer precursors, extender resins such as chlorinated paraffin, and fillers; and nonwovens webs such as made from spun-bonded polyolefins. While base sheets of the latter materials may have more elasticity or memory than a dead-soft material, the elastic force developed after the base sheet is conformed to a roadway surface is generally less than the force imposed by the adhesive holding the sheet material to the roadway, and the base sheet therefore permanently conforms to the roadway surface. Over a period of time preferred materials may conform even further, so as to closely follow small irregularities in the roadway surface such as protruding pebbles. The base sheet is usually between about 0.025 millimeter and one or two millimeters thick to provide desired conformability and strength for the sheet material; dead-soft aluminum foils are usually less than 0.1 millimeter thick.

The top layer applied to the base sheet will most often be between about 0.025 and 0.25 millimeter thick, though larger thicknesses can be used if larger microspheres or other particles are to be embedded in the layer. Preferably the top layer has a thickness of at least 0.1 millimeter.

By far the preferred binder material for use in the top layer of a tape of the invention is based on a diglycidyl ether of hydrogenated bisphenol A (i.e., 2,2-bis[4-(2,3-epoxy propoxy)-cyclohexyl]propane). A first advantage of this resin is that it does not exhibit a color change during aging in a tape of the invention, which other unsaturated epoxy resins may exhibit because of their conjugated double bonds. Furthermore, use of this epoxy resin allows greater flexibility of the cured top layer. Although a flexibilizing polymer is preferably used with the epoxy resin, lower amounts of such a flexibilizing polymer provide greater overall flexibility for the completed top layer than would be the case with diglycidyl ethers of nonhydrogenated bisphenol A. Such lower amounts are an advantage, since the less the dilution of epoxy resin, the better the adhesion to the base sheet and to the particles partially embedded in the top layer. Another advantage of diglycidyl ethers of hydrogenated bisphenol A is that the top layer shows less shrinkage during aging than top layers based on other epoxy resins. Top layers made with at least some other epoxy resins exhibit shrinkage during reaction or curing, either immediately during the manufacturing process or subsequently during aging on the roadway, and this shrinkage can cause a delamination of the top layer from the base sheet or even lifting of the sheet material from the roadway.

However, other epoxy resins can be used for pavement-marking sheet materials of the invention intended for more limited purposes. In general, any curable epoxy resin having on the average more than one reactive epoxy group per molecule is suitable to form a reacted or cured, physically durable, well-adhered top layer useful in sheet material of the invention. For example, diglycidyl ethers of nonhydrogenated bisphenol A can be used, as can cycloaliphatic varieties of epoxy resin, though they are less desirable because of their slower reaction rate and consequently longer manufacturing times.

Acrylonitrile-butadiene flexibilizing polymers are a preferred flexibilizing polymer in epoxy-based top layers of the invention because they form a compatible, flexible and inexpensive top layer. Butadiene polymers also may be used, as may polyethylenediamines such as poly(tetramethyleneoxide) diamine described in U.S. Pat. No. 3,436,359. In general, the useful flexibilizing polymers may be mixed with the epoxy resin in a uniform, finely divided manner. They are generally included in amounts providing less than 250 parts of elastomeric segments per 100 parts of epoxy resin segments.

The flexibilizing polymers preferably incorporate reactive groups for reaction with the epoxy resin, since the strength of the coating appears to be improved in that way. In addition, at least some flexibilizing polymer may be prereacted with epoxy resin prior to incorporation into the top layer. A variety of different kinds of reactive groups may be used, including amine groups, carboxylic acid groups, mercapto groups, and epoxy groups. Amine groups are preferred because they react more quickly with the epoxy resin at useful processing temperatures and therefore shorten the manufacturing time for sheet material of the invention.

Curing agents or catalysts to promote reaction between epoxy groups and/or between epoxy groups and reactive groups on the flexibilizing polymer may be included.

Other polymers or resins may also be used in the top layer instead of or in addition to epoxy resin. For example, urethane-forming polyisocyanate and polyol mixtures may be used to form a top layer well-adhered to the base sheet and to particulate matter partially embedded in the top layer. Furthermore, urethane polymers may be made inherently flexible without addition of a flexibilizing polymer.

Although the top layer in sheet material of the invention is generally formed by coating liquid ingredients directly onto the base sheet, the layer may be formed separately and then bonded to the base sheet in a laminating operation, as by interposing an adhesive layer between the top layer and base sheet.

The wear-resisting particles—glass microspheres or other durable, generally inorganic particulate material—are partially embedded in the top layer, typically in a scattered, or randomly separated manner. A scattered arrangement of glass microspheres provides the level of retroreflectivity typically expected in pavement markings, and is more skid-resistant than a densely packed layer of microspheres. Irregular or angular, inorganic skid-resisting particles such as sand or other abrasive particles will generally be included in sheet material of the invention with the microspheres; and for some uses where no retroreflectivity is needed, skid-resisting particles may be the only particles included. Desirably, sheet material of the invention exhibits a skid resistance of at least 55 BPN as measured on a British Portable Skid Tester, which is specified by various government agencies as a desirable level of skid resistance.

The glass microspheres used typically have an index of refraction of between about 1.5 and 2, and preferably have an index of at least 1.7, to provide good reflectivity under dry conditions. If the sheet material is to reflect when wet, some or all of the microspheres should have an index of refraction of about 2.2 or higher. The microspheres will usually average between about 150 and 500 micrometers in diameter, and other particulate material will generally be of the same order of size.

As previously noted, the microspheres or other embedded particles are preferably treated with an agent that improves adhesion between them and the top layer; or such an agent is included in the top layer, where it contacts the microspheres or particles when they are embedded in the layer. The molecules of such an agent generally have an inorganophilic portion, which associated with the embedded microspheres or particles, and an organophilic portion, which associates with and may react with organic ingredients of the top layer. Silane coupling agents are especially useful.

Pigmemts or other coloring agents will be included in the top layer in an amount sufficient to color the sheet material for use as a traffic-control marking. Titanium dioxide will typically be used for obtaining a white color, whereas lead chromate will typically be used to provide a yellow color. Red and orange are also standard traffic-control colors, and other colors can be used for special-purpose markings.

An adhesive layer may be carried in the sheet material of the invention or adhesive may be applied to a surface and the sheet material adhered over the layer of adhesive. Pressure-sensitive adhesives are preferred, but heat- or solvent-activated adhesives or contact adhesives may be used.

Sheet material of the invention is most often applied as an elongated tape, but other shapes may be used, as for providing legends, arrows, stop bars and the like.

The invention will be further illustrated by the following examples.

EXAMPLE 1

A mixture was prepared from the following ingredients:

| | Parts by Weight |
|---|---|
| Diglycidyl ether of hydrogenated bisphenol A having an epoxide equivalent weight of approximately 235 (DRH-151 epoxy resin from Shell Chemical Company) | 38 |
| Amine-terminated acrylonitrile-butadiene elastomer-precursor having an approximate molecular weight of 4000, a bound acrylonitrile content of 16 weight-percent, and an amine functionality of two (Hycar ATBN from B. F. Goodrich) | 19 |
| Titanium dioxide pigments | 26 |
| Ethylene oxide adduct to diethylene triamine (Ancamine T-1) | 5 |
| A solvent mixture of three parts of methyl ethyl ketone and one part ethylene glycol monobutyl ether | 12 |

This mixture was coated onto a 50-micrometer-thick sheet of dead-soft alumimnum foil. Thereafter, a mixture of glass microspheres ranging from 150 to 250 micrometers in diameter and averaging 200 micrometers in diameter and having an index refraction of about 1.7, and particles of sand of approximately the same size were dropped onto the surface of the still-liquid coating. The microspheres and sand had been treated with a gamma-amino propyltriethoxy silane coupling agent. Thereupon the coating was cured for 10 minutes at 150° C. A layer of butyl-rubber-based rubber-resin pressure-sensitive adhesive which had been previously solution-coated onto a release liner was then laminated to the bottom side of the aluminum foil. The sheet was cut into 10-centimeter widths suitable for lane marking and wound into a storage roll.

EXAMPLE 2

An alternative top layer for use in a construction as described in Example 1 comprises the following ingredients:

| | Parts by Weight |
|---|---|
| Polyfunctional aliphatic isocyanate (Desmodur N from Mobay Chemical Company) | 12 |
| Hydroxyl-terminated polyester having a hydroxyl number of 45 (Multron R16 from Mobay Chemical Company) | 62.5 |
| Titanium dioxide | 25 |
| Dibutyl tin dilaurate | 0.5 |

These ingredients may be mixed and coated onto aluminum foil as a 100-percent-nonvolatile liquid. FOOTNOTES: 1. "Elastomer" and "elastomeric" are used in this specification to describe substances that can be stretched at room temperature to at least twice their original length, and after having been stretched and the stress removed, return with force to approximately their original length in a short time. "Vulcanizable elastomer-precursor," or more simply "elastomer-precursor," is used in this specification to mean polymeric materials that may be crosslinked in a vulcanizing-type reaction to provide a substance that meets the above description. As an example, for purposes of this specification, "vulcanizable elastomer-precursor" and "elastomer-precursor" include so-called liquid elastomers such as liquid acrylonitrile-butadiene polymers. "Segment" is used in this specification to mean a molecule or portion of a molecule. "Elastomeric segments" is used to describe either separate elastomeric molecules or portions of molecules that would be elastomers or vulcanizable elastomer precursors as described above if they were a separate molecule rather than a portion of a molecule. "Epoxy-resin segments" is used to describe either separate molecules having one or more reactive epoxy groups or to describe portions of molecules that have the same structure and composition as the separate epoxy resin molecules just described.

What is claimed is:

1. Pavement-marking sheet material comprising (a) a base sheet that is conformable to a roadway surface;

(b) a top layer adhered to one surface of the base sheet and reacted to a substantially infusible, insoluble, and flexible state in which the top layer conforms and remains adhered to the base sheet without rupture even when the sheet material is wrapped around a one-millimeter-diameter mandrel; the top layer containing coloring agents sufficient to color the sheet material for utility as a traffic-control marking; and (c) a monolayer of particles partially embedded in the top layer and partially exposed above the top layer;

the top layer encircling the particles such that at points one radius removed from the periphery of an average-diameter particle, the top layer has a thickness of at least one-third the particle diameter and has receded below its level on the particle by no more than one-third the particle diameter, whereby the particles are retained in the top layer and protect the top layer from wear.

2. Pavement-marking sheet material of claim 1 in which the base sheet comprises aluminum foil.

3. Pavement-marking sheet material of claim 1 in which the top layer comprises an epoxy resin.

4. Sheet material of claim 3 in which the epoxy resin comprises a diglycidyl ether of hydrogenated bisphenol A.

5. Pavement-marking sheet material of claim 1 in which the wear-resisting particles are contacted by an adhesion-promoting agent comprising molecules that have one portion that adheres well to the particles and another portion that adheres well to the top layer.

6. Pavement-marking sheet material of claim 1 in which the wear-resisting particles comprise glass microspheres.

7. Pavement-marking sheet material of claim 1 in which the wear-resisting particles comprise skid-resisting particles.

8. Pavement-marking sheet material of claim 1 in which the wear-resisting particles comprise a mixture of glass microspheres and skid-resisting particles.

9. Pavement-marking sheet material comprising (a) a base sheet that conforms under pressure to a roadway;

(b) a top layer adhered to one surface of the base sheet and comprising an epoxy resin having on the average more than one reactive epoxy group per molecule, a flexibilizing polymer which provides at least 5 weight-parts of elastomeric segments in the top layer per 100 weight-parts of epoxy resin segments, and coloring agents sufficient to color the top layer for utility as a traffic-control marking; the top layer conforming and adhering to the base sheet without rupture even when the sheet material is wrapped around a one-millimeter-diameter mandrel; and (c) a monolayer of particles partially embedded in the top layer and partially exposed above the top layer;

the top layer encircling the particles such that at points one radius removed from the periphery of an average-diameter particle, the top layer has a thickness of at least one-third the particle diameter and has receded below its level on the particle by no more than one-third the particle diameter, whereby the particles are retained in the top layer and protect the top layer from wear.

10. Pavement-marking sheet material of claim 9 in which the wear-resisting particles are contacted by an adhesion-promoting agent comprising molecules that have one portion that adheres well to the particles and another portion that adheres well to the top layer.

11. Pavement-marking sheet material of claim 9 that further includes a layer of adhesive on the bottom surface of the base sheet.

12. Pavement-marking sheet material of claim 9 in which the epoxy resin comprises a diglycidyl ether of hydrogenated bisphenol A.

13. Pavement-marking sheet material of claim 9 in which the flexibilizing polymer comprises an acrylonitrile-butadiene polymer.

14. Pavement-marking sheet material of claim 9 in which the flexibilizing polymer carries reactive groups through which it is reacted with the epoxy resin.

15. Pavement-marking sheet material of claim 14 in which the reactive groups comprise amine groups.

16. Pavement-marking sheet material comprising (a) a base sheet that conforms under pressure to a roadway surface;

(b) a top layer between about 25 and 250 micrometers thick adhered on one surface of the base sheet and comprising (i) diglycidyl ether of hydrogenated bisphenol A;

(ii) flexibilizing polymer which provides at least 5 parts of elastomeric segments per 100 parts of epoxy resin segments in the top layer, and which carries reactive groups through which the flexibilizing polymer is reacted with the diglycidyl ether of bisphenol A; and (iii) coloring agents sufficient to color the sheet material for utility as a traffic-control marking;

the top layer conforming and adhering to the base sheet without rupture even when the sheet material is wrapped around a one-millimeter-diameter mandrel; and (c) a monolayer of inorganic particles partially embedded in the top layer and partially exposed above the top layer, said particles being contacted by an adhesion-promoting agent having an inorganophilic portion and an organophilic portion; the top layer being filleted around the particles in a flat fillet such that at points one radius removed from the periphery of an average-diameter particle; the top layer has a thickness of at least one-third the particle diameter and has receded below its level on the particle by no more than one-third the particle diameter, whereby the particles are retained in the top layer and protect the top layer from wear.

17. Pavement-marking sheet material of claim 16 in which the flexibilizing polymer comprises an acrylonitrile-butadiene polymer.

18. Pavement-marking sheet material of claim 17 in which the reactive groups carried by the acrylonitrile-butadiene polymer are amine groups.

19. Pavement-marking sheet material of claim 16 in which the wear-resisting particles comprise glass microspheres.

20. Pavement-marking sheet material of claim 16 in which the wear-resisting particles comprises skid-resisting particles.

21. Pavement-marking sheet material of claim 16 in which the wear-resisting particles comprise a mixture of glass microspheres and skid-resisting particles.

* * * * *